US005317521A

United States Patent [19]

Lin et al.

[11] Patent Number: 5,317,521

[45] Date of Patent: May 31, 1994

[54] PROCESS FOR INDEPENDENTLY MONITORING THE PRESENCE OF AND CONTROLLING ADDITION OF SILVER AND HALIDE IONS TO A DISPERSING MEDIUM DURING SILVER HALIDE PRECIPITATION

[75] Inventors: Ming-Jye Lin; Jong-Shinn Wey, both of Penfield, N.Y.

[73] Assignee: Eastman Kodak Company, Rochester, N.Y.

[21] Appl. No.: 745,668

[22] Filed: Aug. 16, 1991

[51] Int. Cl.[5] ..... G06G 7/57

[52] U.S. Cl. ..... 364/496; 364/497; 430/569

[58] Field of Search ..... 364/496, 497, 500; 430/434, 567, 569

[56] References Cited

U.S. PATENT DOCUMENTS

| | | | |
|---|---|---|---|
| 3,999,048 | 12/1976 | Parthemore | 235/151.12 |
| 4,334,012 | 6/1982 | Mignot | 430/569 |
| 4,497,895 | 2/1985 | Matsuzaka et al. | 430/569 |
| 4,755,456 | 6/1988 | Sugimoto | 430/569 |
| 4,838,999 | 6/1989 | Haar et al. | 422/100 |
| 4,914,014 | 4/1990 | Daubendiek et al. | 430/569 |
| 4,933,870 | 6/1990 | Chang | 364/497 |
| 5,035,991 | 6/1991 | Ichikawa et al. | 430/569 |
| 5,102,528 | 4/1992 | Robert | 204/419 |
| 5,104,786 | 4/1992 | Chronis et al. | 430/467 |
| 5,145,768 | 9/1992 | Ichikawa et al. | 430/569 |

OTHER PUBLICATIONS

Weissberger et al., "Physical Methods of Chemistry", Techniques of Chemistry, vol. I, pp. 134–135.

*Primary Examiner*—Thomas G. Black
*Assistant Examiner*—Tan Q. Nguyen
*Attorney, Agent, or Firm*—Carl O. Thomas

[57] ABSTRACT

A process and apparatus for precipitating a silver halide emulsion is disclosed. The process is comprised of the steps of adding silver ions to a dispersing medium containing halide ions within a reaction vessel to initiate growth of silver halide grains within the dispersing medium, monitoring the temperature of the dispersing medium to establish the equilibrium solubility product constant of silver and halide ions within the dispersing medium; concurrently, using a reference electrode and a first indicator electrode, monitoring the halide ion activity within the dispersing medium; and adjusting the level of dissolved halide ion in the reaction vessel to maintain a stoichiometric excess of halide ions, based on the equilibrium solubility product constant. In the process the potential difference between a silver ion specific electrode in contact with the dispersing medium within the reaction vessel and at least one of the first indicator electrode and the reference electrode is concurrently monitored to allow the level of dissolved silver ion to be determined independently of the equilibrium solubility product constant, and the level of dissolved silver ion in the dispersing medium is adjusted based on the potential difference to maintain a selected profile of dissolved silver ion during silver halide grain growth. The apparatus contains the elements necessary for the practice of the process.

14 Claims, 6 Drawing Sheets

PROCESS FOR INDEPENDENTLY MONITORING THE PRESENCE OF AND CONTROLLING ADDITION OF SILVER AND HALIDE IONS TO A DISPERSING MEDIUM DURING SILVER HALIDE PRECIPITATION

FIELD OF THE INVENTION

The invention relates to a process for the preparation of a photographic silver halide emulsion and to an apparatus for precipitating a silver halide emulsion.

PRIOR ART

Chang U.S. Pat. No. 4,933,870 is representative of conventional arrangements for monitoring the concentration of dissolved ion during the precipitation of a silver halide emulsion.

SUMMARY OF THE INVENTION

In one aspect, this invention relates to a process of precipitating a silver halide emulsion comprised of (a) adding silver ions to a dispersing medium containing halide ions within a reaction vessel to initiate growth of silver halide grains within the dispersing medium, (b) monitoring the temperature of the dispersing medium to establish the equilibrium solubility product constant of silver and halide ions within the dispersing medium, (c) concurrently, using a reference electrode and a first indicator electrode, monitoring the halide ion activity within the dispersing medium, and (d) adjusting the level of dissolved halide ion in the reaction vessel to maintain a stoichiometric excess of halide ions, based on the equilibrium solubility product constant, The process is characterized in that the potential difference between a silver ion specific electrode in contact with the dispersing medium within the reaction vessel and at least one of the first indicator electrode and the reference electrode is concurrently monitored to allow the level of dissolved silver ion to be determined independently of the equilibrium solubility product constant and the level of dissolved silver ion in the dispersing medium is adjusted based on the potential difference to maintain a selected profile of dissolved silver ion during silver halide grain growth.

In another aspect, this invention is directed to an apparatus for the precipitation of a silver halide emulsion comprised of (a) a reaction vessel capable of confining a dispersing medium, (b) means for controlling the introduction of silver and halide ions into the dispersing medium, (c) means mounted in the reaction vessel to sense the temperature of the dispersing medium, and (d) means, including a first indicator electrode and a reference electrode, mounted in the reaction vessel to sense the dissolved halide ion level within the dispersing medium.

The apparatus is characterized in that a silver ion specific electrode is mounted within the reaction vessel to contact the dispersing medium and means are provided for comparing the potential of at least one of the first indicator electrode and the reference electrode to the potential of the silver ion specific electrode.

DESCRIPTION OF PREFERRED EMBODIMENTS

A photographic silver halide emulsion contains radiation-sensitive silver halide grains and a dispersing medium comprised of water and a peptizer. The emulsion is formed by precipitating dissolved silver and halide ions to form the grains, which are microcrystals made up of silver and halide ions. Water acts as a solvent for the dissolved ions while the function of the peptizer is to prevent clumping of the grains as they are being grown.

Figure 1:
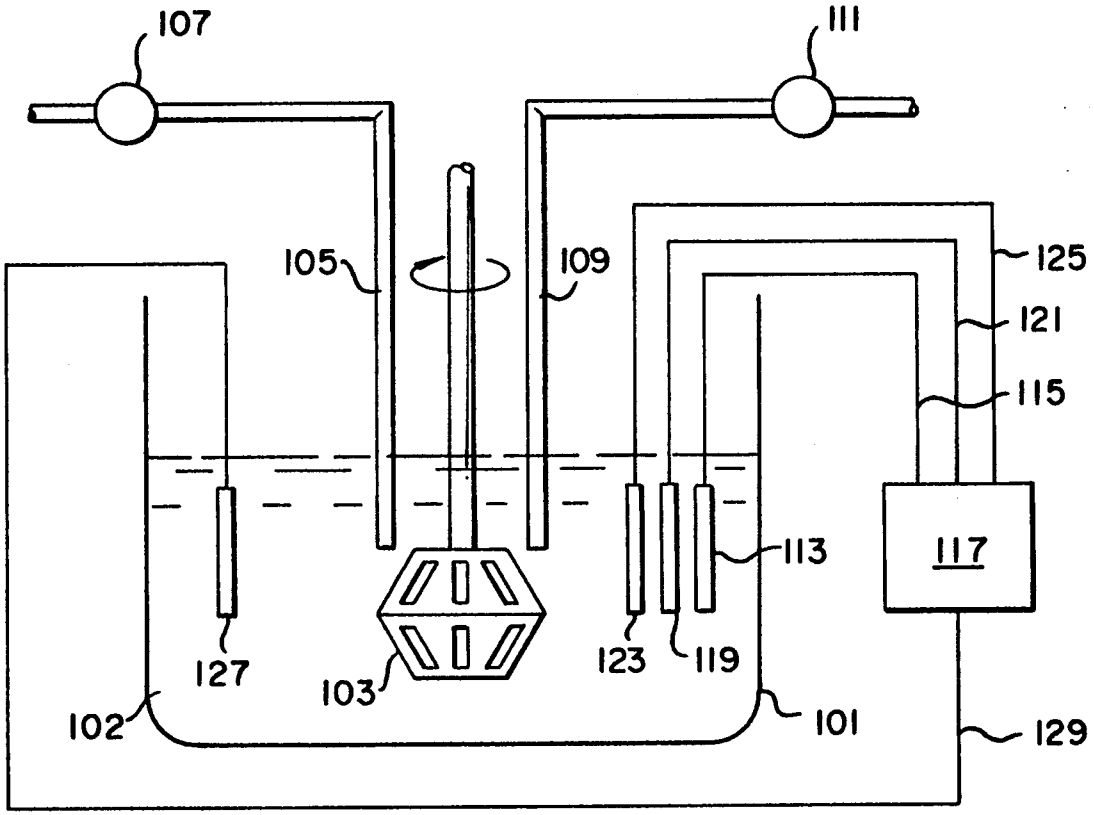
FIG. 1 is a schematic diagram of an arrangement according to the invention for the precipitation of a photographic silver halide emulsion.

An arrangement for the precipitation of a photographic silver halide emulsion is shown in FIG. 1. A reaction vessel 101 is provided which contains a dispersing medium 102. At the outset of precipitation the dispersing medium is comprised of water and dissolved halide ion. The purpose of including halide ion in the dispersing medium prior to the introduction of silver ion is to insure that the dispersing medium at all times contains a stoichiometric excess of halide ion as compared to silver ion, thereby minimizing the number of grains that develop spontaneously without radiation exposure, observed photographically as minimum density (i.e., fog). Peptizer need not be present in the dispersing medium at the onset of precipitation, since very small silver halide grains can remain dispersed in the absence of peptizer. However, it is generally convenient to incorporate at least a small percentage of the peptizer in the dispersing medium prior beginning precipitation.

Once the dispersing medium has been constituted as desired, silver halide grain growth in the reaction vessel is initiated by introducing silver ions into the dispersing medium while the latter is vigorously stirred. A rotatable stirring mechanism 103 is shown. Most commonly an aqueous silver salt solution, usually a silver nitrate solution, is added through a silver jet, such as jet 105 controlled by a flow regulator 107, while a halide salt solution, usually an alkali halide solution, is concurrently added through a halide jet, such as jet 109 controlled by flow regulator 111. Dissolved silver ion, $Ag^+$, reacts with dissolved halide ion, $X^-$, to produce silver halide, AgX, according to the following equation:

$$Ag^+ + X^- \rightarrow AgX \quad \text{(I)}$$

where $X^-$ represents any one or combination of chloride, bromide and iodide ions.

When a silver salt solution is added to the dispersing medium, silver halide precipitation takes place in two steps. In the first step, referred to as the nucleation step, silver halide grain nuclei are formed while any existing grains are grown by the further deposition of silver halide on the surface of the grain nuclei. In the second step, no additional silver halide grains are formed, and all additionally precipitated silver halide goes to increase the size of the existing grain population.

It is possible to perform the nucleation step prior to introducing silver ion into the reaction vessel, so that only silver halide grain growth occurs in the reaction vessel. In this approach dispersed fine ($<0.05$ μm) silver halide grains, typically a Lippmann emulsion, is introduced through the silver jet. The first grains to be introduced into the dispersing medium within the reaction vessel serve as hosts for the deposition of additional silver halide, as indicated by the following equation:

$$(AgX)_S \rightarrow Ag^+ + X^- \rightarrow (AgX)_L \quad \text{(II)}$$

where $(AgX)_S$ represents smaller silver halide grains and $(AgX)_L$ represents larger silver halide grains.

By comparing equations (I) and (II) it is apparent that in both instances it is dissolved silver and halide ions that react to produce the product grain population. The difference is that silver ions are added to the reaction vessel as a dissolved solute in the equation (I) approach while silver ions are added to the reaction vessel as grain nuclei in the equation (II) approach.

Since the reaction vessel initially contains halide ion, it is recognized that only the addition of silver ion is required to form a silver halide emulsion. Thus, it is possible to eliminate the halide jet 109 entirely. Although this approach, referred to as single-jet precipitation, has been extensively employed historically in the art, in contemporary emulsion manufacture it is, in the overwhelming majority of applications, preferred to have the option of starting with lower levels of halide in the dispersing medium prior to silver ion addition and providing additional halide ion as grain precipitation progresses. This allows the level of dissolved halide ion within the reaction vessel throughout precipitation (i.e., the halide ion profile) to be chosen, as desired, during precipitation. Separate jets can be provided for independently adding each halide ion when mixed halide grains are formed, and it is also contemplated to employ a separate jet for the further addition of dispersing medium, although none of these additional jets are required.

Halide ion levels in the dispersing medium during precipitation can affect the photographic properties of the emulsions in a variety of ways. For instance, halide ion levels can determine grain regularity (e.g., the presence or absence of twin planes) and grain crystal habit (e.g., the extent to which the grains exhibit {100} and/or {111} crystal facets). However, the most fundamental reason for regulating halide ion levels in the dispersing medium is to insure that a stoichiometric excess of halide ions in relation to silver ions is present in the reaction vessel.

To appreciate how the halide ion level in the reaction vessel is determined it is necessary to recognize that equation (I) is, like almost all formula representations of chemical reactions, a simplification. In its complete form, the equation is as follows:

$$Ag^+ + X^- \rightleftharpoons AgX \quad \text{(III)}$$

While at equilibrium almost all of the silver and halide ions are present in the AgX crystal structure, a low level of $Ag^+$ and $X^-$ remain in solution. At any given temperature the activity product of $Ag^+$ and $X^-$ is, at equilibrium, a constant and satisfies the relationship:

$$K_{SP} = [Ag^+][X^-] \quad \text{(IV)}$$

where $[Ag^+]$ represents the equilibrium silver ion activity, $[X^-]$ represents the equilibrium halide ion activity, and $K_{SP}$ is the solubility product constant of the silver halide.

To avoid working with small fractions, the following relationship is also widely employed:

$$-\log K_{SP} = pAg + pX \quad \text{(V)}$$

where pAg represents the negative logarithm of the equilibrium silver ion activity and pX represents the negative logarithm of the equilibrium halide ion activity.

The solubility product constants of the photographic silver halides are well known. The solubility product constants of AgCl, AgBr and AgI over the temperature range of from 0° to 100° C. are published in Mees and James, *The Theory of the Photographic Process*, 3rd Ed., Macmillan, 1966, at page 6. At 40° C., a typical precipitation temperature, the $K_{SP}$ of AgCl is $6.22 \times 10^{-10}$, of AgBr is $2.44 \times 10^{-12}$, and of AgI is $6.95 \times 10^{-16}$. Because of the large differences in solubility produced by the different halides, when mixed halide emulsions are being prepared, particularly those in which the less soluble silver halide is present in a minor amount, such as a typical silver bromoiodide emulsion, the activity of the less soluble halide makes no significant contribution to the solubility product constant and can be ignored.

Since the stoichiometric molar ratio (also commonly referred to as the equivalence point) of $Ag^+$ to $X^-$ is 1:1, at any selected temperature the stoichiometric level of halide ion satisfies the following equation:

$$(K_{SP})^{\frac{1}{2}} = [X^-]_S \quad \text{(VI)}$$

where $[X^-]_S$ is the stoichiometric level (activity) of halide ion.

This relationship can alternatively be expressed by the formula:

$$-\log K_{SP} \div 2 = pX_S \quad \text{(VII)}$$

where $pX_S$ is the negative logarithm of halide activity at the equivalence point.

In FIG. 1 a temperature sensor 113 is shown connected through lead 115 to an interfacing device 117. Also shown in FIG. 1 is a reference electrode 119 connected to the interfacing device through a lead 121 and a first indicator electrode 123 connected to the interfacing device through a lead 125.

The first indicator electrode is a halide ion specific electrode. The reference electrode and the first indicator electrode provide an electrical potential difference indicative of the halide ion activity within the dispersing medium. The first indicator electrode can take the form of a conventional silver electrode of the second kind, such as the Ag/AgX "silver" indicator electrode of Chang U.S. Pat. No. 4,933,870.

The reason that a silver electrode of the second kind measures halide ion activity during silver halide precipitation requires some familiarity with its construction. A silver electrode of the second kind is typically formed by anodizing a silver billet in a halide salt solution (e.g. KBr) so that as metallic silver atoms are oxidized to silver ions and enter solution they react with halide ions to form a silver halide coating on the billet. The result is a porous silver halide coating on the metallic silver billet surface.

In use, the dispersing medium enters the pores of the silver halide coating of the silver electrode of the second kind and contacts the surface of the silver billet. The electrode measures the silver ion activity at the billet interface with the dispersing medium. The potential measured satisfies the following equation:

$$E_{Ag(2)}=E_{Ag^{\circ}}+(RT\div F)\ln[Ag^{+}]_i \quad \text{(VIII)}$$

where $E_{Ag(2)}$ is the potential in millivolts of the silver electrode of the second kind, $E_{Ag^{\circ}}$ is a standard reduction potential in millivolts of a silver electrode at unity silver ion activity at the temperature of the dispersing medium, R is the gas constant (8.3145 J/mol/°K.), T is temperature (°K.), F is the Faraday constant (96,485 C/mol), and $[Ag^{+}]_i$ is the silver ion activity at the billet interface.

At the billet interface the halide ions and silver ions are in equilibrium and satisfy the relationship:

$$K_{SP}=[Ag^{+}]_i[X^{-}]_i \quad \text{(IX)}$$

where $[Ag^{+}]_i$ is as defined above and $[X^{-}]_i$ is the halide ion activity at the billet interface.

Since the dispersing medium under silver halide precipitation conditions contains a large stoichiometric excess of halide ion, the halide ion activity at the billet interface, $[X^{-}]_i$, is the same as the halide ion activity in the bulk of the dispersing medium, $[X^{-}]_b$. In other words:

$$[X^{-}]_i=[X^{-}]_b=[X^{-}]_{bi} \quad \text{(X)}$$

where $[X^{-}]_{bi}$ is halide ion activity level measured at the electrode interface that corresponds to the halide ion activity level in the bulk of the dispersing medium. By substituting $[X^{-}]_{bi}$ for $[X^{-}]_i$ in equation IX and then substituting in equation VIII, the following equation is obtained:

$$E_{Ag(2)}=E_{Ag^{\circ}}+(RT\div F)\ln(K_{SP}\div[X^{-}]_{bi}) \quad \text{(XI)}$$

where each of the terms is as defined above.

If an equilibrium relationship existed throughout the dispersing medium, the silver electrode of the second kind would accurately measure the silver ion activity of the bulk dispersing medium. Unfortunately, only the silver and halide ions in the pores of the electrode at the billet interface are in equilibrium. The bulk silver ion activity, $[Ag^{+}]_b$, does not equal or, in most instances, even approximate the interface silver ion activity, $[Ag^{+}]_i$. Thus, as between bulk activities of silver ion and halide ion, it is the halide ion activity, $[X^{-}]_{bi}$, that is as a practical matter measured by silver electrodes of the second kind (albeit indirectly by measurement of silver ion activity in equilibrium at the electrode interface).

It is preferred to employ a silver electrode of the second kind to monitor the halide ion activity of the dispersing medium, since these electrodes have been used so extensively in the art. However, any conventional electrode capable of monitoring halide ion activity can be employed as the first indicator electrode. For example, the electrode used to monitor the halide ion activity can take the form of a conventional $M^{\circ}/Hg_2X_2$ electrode, where Mo represents any convenient metal, such as mercury, silver, etc. In another form the halide ion specific electrode can take the form of a halide ion permeable membrane electrode, such as an electrode of the type disclosed by Durst *Ion-Selective Electrodes*, Chapters 2 and 3, National Bureau of Standards Special Publication 314, Nov. 1969 (Proceedings of a Symposium held at the National Bureau of Standards, Gaithersburg, Maryland, Jan. 30–31, 1969). When the silver electrode of the second kind is replaced by another electrode choice, the term $E_{Ag^{\circ}}$ must be replaced with another potential reflective of the potential characteristic of that electrode.

In its simplest possible form the interfacing device displays the temperature of the dispersing medium and the potential difference between the reference electrode and the first indicator electrode for an operator to view. The operator can then manually adjust the halide jet flow regulator to obtain the desired halide ion profile during precipitation. In their simplest form the flow regulators are manually controlled valves. In practice the flow regulators are preferably pumps, and the interfacing device is capable of adjusting pumping rates to satisfy instructions for maintaining a predetermined dissolved halide ion profile during precipitation without operator assistance while precipitation is in progress.

The difficulty which the art has encountered in attempting to control silver halide precipitation relying on the potential difference between a reference electrode and a silver electrode of the second kind stems from reliance on the solubility product constant $K_{SP}$, see equation (XI) above. Unfortunately, this equation is based on the assumption of equilibrium; however, at no time during the precipitation does an equilibrium condition obtain. When a silver halide grain is in equilibrium with its environment, the rate of silver and halide deposition is equal to the rate at which silver and halide ions reenter solution from the grain surfaces, and no net precipitation of silver halide occurs.

What happens in manufacture is that several photographic silver halide emulsions can be precipitated under what are believed to be identical conditions, based on the best conventional control arrangements (i.e., as illustrated by Chang U.S. Pat. No. 4,933,870), without all of the emulsions having the same sensitometric properties. As demonstrated in the Examples below silver halide emulsions precipitated with identical measured halide ion activity levels in the dispersing medium can exhibit widely variant size-frequency distributions of silver halide grains. Emulsions with differing size-frequency distributions exhibit different levels of photographic speed and contrast, attributable to the differing grain populations present.

The improvement which the present invention brings to the art of photographic emulsion precipitation is the capability of accurately assessing silver and halide ion activity in the dispersing medium during precipitation. With this approach the false assumption of equilibrium conditions forms no part of choosing conditions controlling the precipitation process.

This invention achieves for the first time an accurate assessment of the supersaturation of the dispersing medium by reactant ions. Reactant ion supersaturation is the difference between the equilibrium amount of the reactant ion in the dispersing medium and its actual amount. The problem which the present invention addresses, that of obtaining identical emulsion properties using identical halide ion profiles during precipitation, has been discovered to have as its solution the monitoring and control of silver ion supersaturation during precipitation. Conventional silver halide emulsion precipitation techniques, which employ a single indicator electrode in combination with a reference electrode, lack this capability.

Referring to FIG. 1, a second indicator electrode, a silver ion specific electrode, 127 is shown connected to the interfacing device 117 through a lead 129. The second indicator electrode directly measures the activity of silver ion in solution at its surface and is preferably a silver electrode of the first kind. A preferred silver electrode of the first kind is a metallic silver or silver alloy electrode. It is also contemplated that a $Ag/Ag_2S$ electrode or a silver ion permeable membrane electrode can be employed for measuring silver ion supersaturation within the dispersing medium. Exemplary electrodes are disclosed by Durst, cited above.

The relationship between the potential measured by a silver electrode of the first kind and the activity of dissolved silver ion in the dispersing medium is represented by the following equation:

$$E_{Ag(1)}=E_{Ag^+}+(RT\div F)\ln[Ag^+]_{bi} \quad \text{(XII)}$$

where $E_{Ag(1)}$ is the potential in millivolts of the silver electrode of the first kind, $[Ag^+]_{bi}$ is the activity of the silver ion in the dispersing medium (the subscript "bi" denoting that the same activity level exists both at the electrode surface and in the bulk of the dispersing medium), and each of the remaining terms of the equation are as described above.

If an electrode of the second kind is employed as the first indicator electrode and a silver electrode of the first kind is employed as the second indicator electrode, the difference in the potentials obtained provides a measure of the supersaturation of the silver ion in the dispersing medium—i.e., the difference between the equilibrium interface silver ion activity and the bulk silver ion activity. When the potential of the silver electrode of the first kind is more positive than the potential of the silver electrode of the second kind, the dispersing medium is supersaturated with silver ion. Instead of directly comparing the potentials of the two indicator electrodes, it is, of course, possible to compare the potential of each to the potential of the reference electrode, followed by comparison of the potential differences.

Since supersaturation of the dispersing medium by dissolved silver ion is the driving force that causes silver halide precipitation to occur, silver ion supersaturation is not objectionable in itself and is, in fact, essential. What is important to reproducible emulsion manufacture is that the level of silver ion supersaturation be measured and controlled. Excessive levels of silver ion supersaturation can cause renucleation to occur and change the size-frequency grain distribution of the emulsion and, consequently, its photographic properties.

Using a silver electrode of the first kind as a second indicator electrode in combination with a silver electrode of the second kind as a first indicator electrode has the advantage that the silver electrode of the second kind can continue to be used in its conventional way to monitor and regulate halide ion activity within the dispersing medium. In a very simple precipitation arrangement the operator can observe the potential of the first indicator electrode and adjust the halide ion introduction rate by turning a valve or adjusting the speed of a pump regulating the halide jet in the exactly the same way this is conventionally done in the art. The same operator can compare the potential of the second indicator electrode to that of the first indicator electrode or the reference electrode and adjust the rate of addition of silver ion to the dispersing medium through the silver jet, again by turning a valve or by adjusting the speed of a pump. More sophisticated controls of the type disclosed by Chang U.S. Pat. No. 4,933,270 or Parthemore U.S. Pat. No. 3,999,048, the disclosures of which are here incorporated by reference, can be used to regulate silver and halide ion introduction rates automatically to maintain selected silver and halide ion profiles in the dispersing medium during precipitation.

By subtracting the potential obtained by equation (XII) from that obtained by equation (XI), the supersaturation potential, $V_S$, of the emulsion can be obtained, as illustrated by the following equation:

$$V_S=V_{SO}+(RT\div F)\ln([Ag^+]_{bi}[X^-]_{bi}\div K_{SP}) \quad \text{(XIII)}$$

where $V_S$ is the supersaturation potential in millivolts, $V_{SO}$ is the difference in the standard reduction potentials of the first and second indicator electrodes at unity activity levels, and all of the remaining terms are as previously defined. When the first indicator electrode is a silver electrode of the second kind $V_{SO}$ is $(E_{Ag^+}-E_{Ag^+})$—that is, zero.

From equation (XIII) it is possible to determine the supersaturation ratio, S, of the dispersing medium, where the supersaturation ratio by definition satisfies the following equation:

$$S=[Ag^+]_{bi}[X^-]_{bi}+K_{SP} \quad \text{(XIV)}$$

By solving equation (XIII) for S (that is, $[Ag^+]_{bi}[X^-]_{bi}\div K_{SP}$) the following equation is obtained:

$$S=e^{11.6(V_S-V_{SO})\div T} \quad \text{(XV)}$$

where e is the Naperian logarithm base (2.71828) and all other terms are as previously defined.

Having the ability to measure bulk activities of halide and silver ions at the surfaces, of the first and second indicator electrodes, respectively, greatly simplifies the monitoring procedure. Nevertheless, it must be borne in mind that the equations presented above are based on the availability of ideal electrodes—those that are capable of responding to only halide ion activity or only silver ion activity to the exclusion of all possible competing interactions and that conform to the Nernstian (RT÷F) slope. In actuality, small departures from theoretically predicted potential measurements are common in potential measurements of all kinds. For example, the bare metal surface provided by the silver ion specific electrode can be expected to undergo some degree of unwanted oxidation by dispersion medium components, such as gelatin components or dissolved oxygen. Periodic removal and reduction of the surface of the silver ion specific electrode can be used to maximize the integrity of electrode potential measurements. In practice departures from theoretical potentials in absolute terms are relatively unimportant, since it is the differences in potential measurements that are compared and relied upon.

In the foregoing discussion the use of silver ion electrodes of the second kind for halide ion activity monitoring has been described, since this has the advantage of keeping the potential readings and monitoring as nearly comparable to conventional potential measurements as possible. Taking this approach, supersaturation monitoring and control can be added onto existing procedures for establishing desired levels of silver and halide ions in the dispersing medium in relation to their stoichiometric ratios.

In an alternative approach equation, instead of resorting to equation (XI) to establish halide ion activity levels, the following equation can be employed:

$$E_X = E_X^{\circ} + (RT \div F) \ln [X^-]_{bi} \quad \text{(XVI)}$$

where $E_X$ is the potential in millivolts of the first indicator electrode, $E_X^{\circ}$ is a standard reduction potential in millivolts of a halide ion specific electrode at unity halide ion activity at the temperature of the dispersing medium, and all of the remaining terms are as previously defined.

The silver ion activity of the reaction vessel can be determined by comparing the potential of the second indicator electrode to that of the reference electrode to obtain $E_{Ag(1)}$. Using this measured value, equation (XII) can be solved for $[Ag^+]_{bi}$. In the same way, using the first indicator electrode, equation (XVI) can be solved for $[X^-]_{bi}$. Using this approach silver ion supersaturation is determined by the following equation:

$$S_{Ag} = [Ag^+]_{bi} - (K_{SP} \div [X^-]_{bi}) \quad \text{(XVII)}$$

where $S_{Ag}$ is silver ion supersaturation and all of the remaining terms are as previously defined.

Although the foregoing description has used unwanted or inadvertent renucleation as an illustration of an emulsion precipitation condition that can be avoided using the process of the invention, it is recognized that the present invention allows renucleation to be achieved in a controlled and reproducible way, if desired. By having an exact knowledge of the supersaturation of the dispersing medium it is possible to initiate renucleation in a controlled and predictable manner during precipitation to produce an additional silver halide population. One advantage of this is that the conventional practice of blending a fine grain emulsion with a larger grain emulsion to obtain a mixed grain population for a specific photographic application can be eliminated simply by precipitating the emulsion with the desired grain populations already interspersed within the emulsion.

Apart from the features specifically described above the details of silver halide emulsion preparation are generally known to those skilled in the art and require no detailed explanation. A summary of silver halide emulsion features, apparatus and precipitation techniques is contained in *Research Disclosure*. Vol. 308, December 1989, Item 308119, Section I, particularly paragraph E, the disclosure of which is here incorporated by reference. *Research Disclosure* is published by Kenneth Mason Publications Ltd., Dudley Annex, 21*a* North Street, Emsworth, Hampshire P010 7DQ, England.

EXAMPLES

The invention can be better appreciated by reference to the following specific examples:

EXAMPLE 1

Seed/Substrate Emulsion

This example describes the preparation of a common substrate emulsion to be used with all of the following examples.

To 3.0 liters of a 2% by weight gelatin aqueous solution containing 0.000066M sodium bromide and 0.1M sodium nitrate at 70° C., pH 5.7, was added with vigorous stirring 0.4M silver nitrate solution and 0.4M sodium bromide solution by double-jet precipitation at a flow rate of 2.4 ml/min for a 60 second nucleation period. This was followed by a linearly accelerated flow rate growth with 0.4M silver nitrate and 0.4M sodium bromide (10.4 X increase in flow rate from start to finish) for 36.7 minutes at pBr 4.29, 70° C. The pBr was then adjusted to 3.29 at 70° C. with sodium bromide for further grain growth in the following examples. A conventional Ag/AgBr silver electrode of the second kind and a conventional Ag/AgCl reference electrode linked through a salt bridge were used to monitor the double-jet precipitation, thereby permitting pBr control. A total of 0.21 mole of cubic grain AgBr emulsion with 0.33 μm mean edge length was obtained.

EXAMPLE 2

Normal Growth with Conventional Silver Electrode of the Second Kind Only

Figure 2:
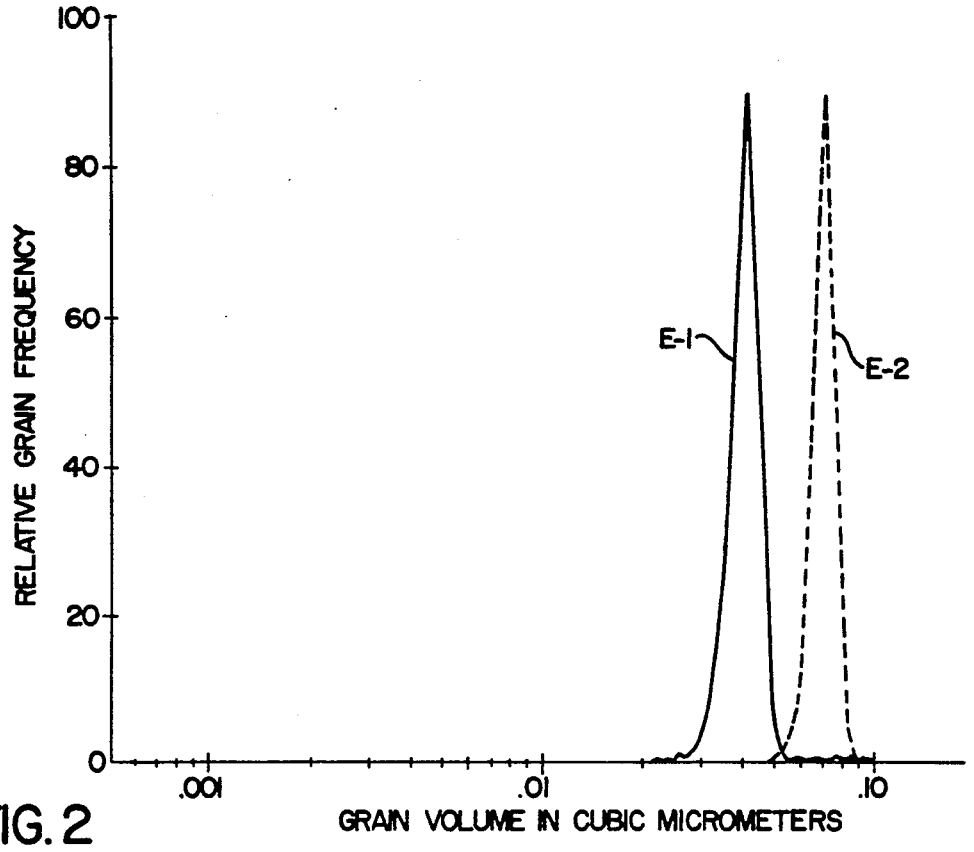
FIGS. 2, 4, 7 and 9 are plots of relative grain frequency versus grain volume in cubic micrometers.
Figure 3:
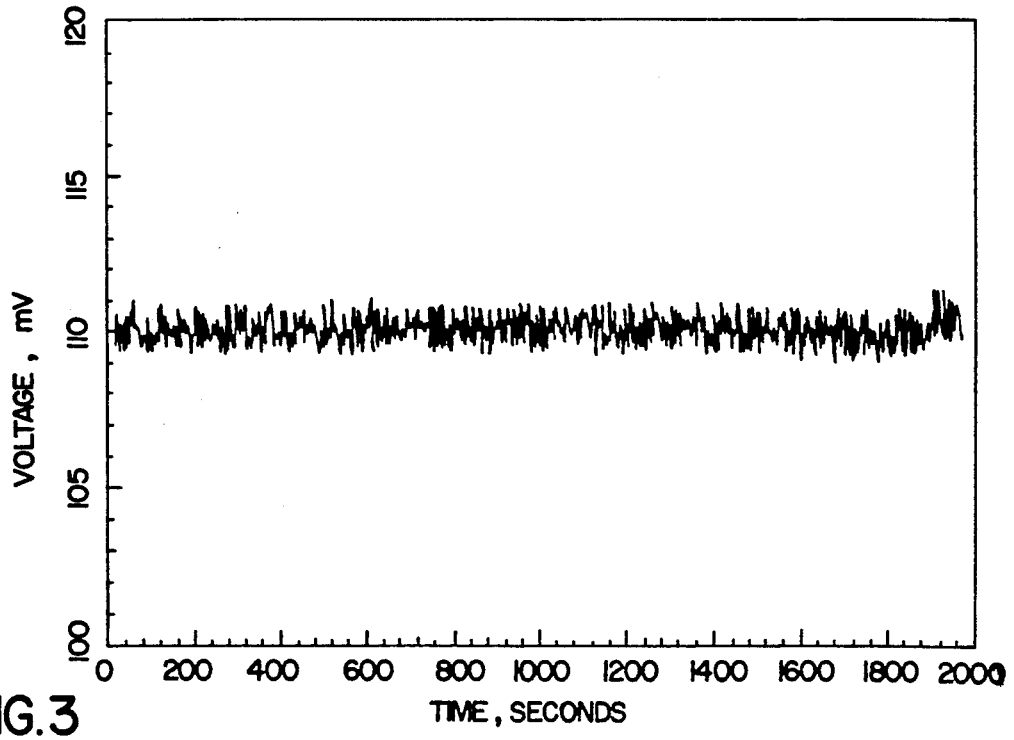
FIGS. 3, 5, 6 and 8 are plots of potential in millivolts versus time in seconds.

To the substrate emulsion described in Example 1 (pBr 3.29, pH 5.7 at 70° C.) were added with vigorous stirring 1.5M silver nitrate and 1.5M sodium bromide by double-jet precipitation using linearly accelerated flow (0.67 ml/min to 6.2 ml/min in 30 minutes). A conventional Ag/AgBr silver electrode of the second kind was used to control pBr. Approximately 0.37 mole of a cubic grain AgBr emulsion with 0.41 μm mean edge length was obtained. FIG. 2 shows the histograms of the grain volume of the substrate emulsion (E-1) and the final emulsion (E-2) of this example. No renucleation was observed. The ratio of mean grain volumes between the emulsion sample of this example and the substrate sample was equal to their silver mole ratio: 0.37/0.21 = 1.76. FIG. 3 shows the potential of the silver electrode of the second kind as a function of time during precipitation. Note the invariance of the potential, which is indicative of the invariance of the pBr during the precipitation.

EXAMPLE 3

Renucleation Growth with Conventional Silver Electrode of the Second Kind Only

Figure 4:
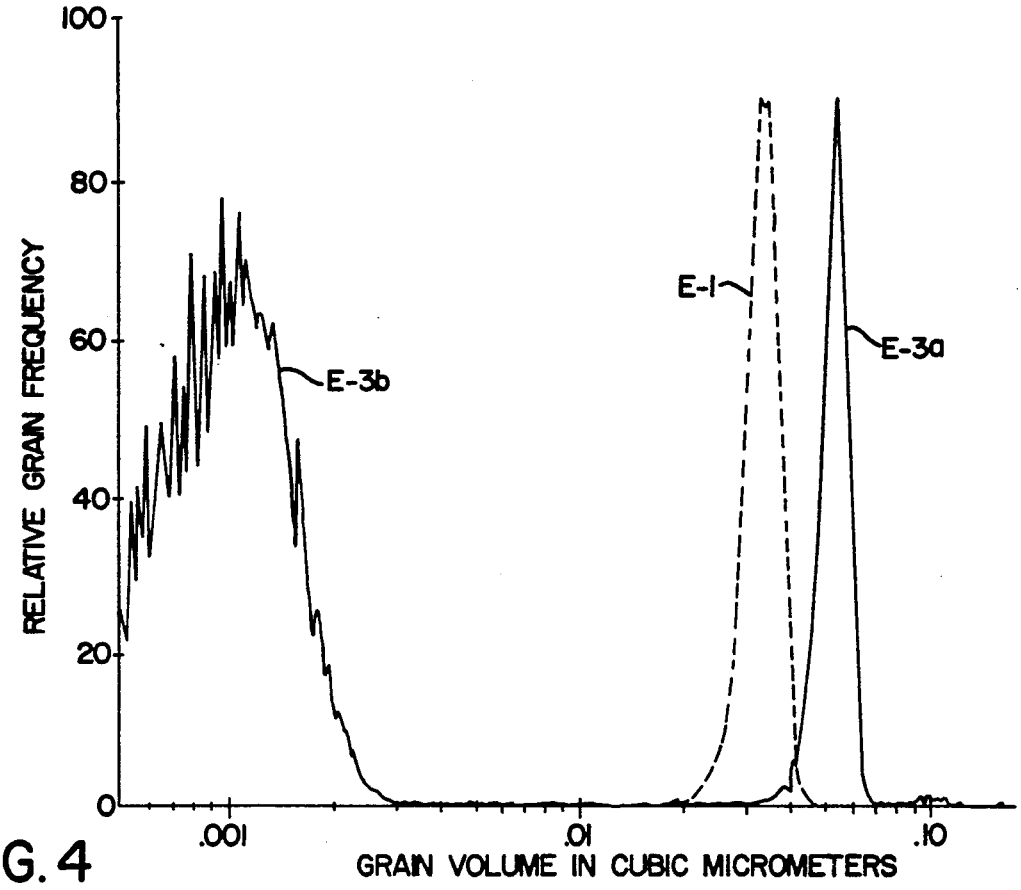
Figure 5:
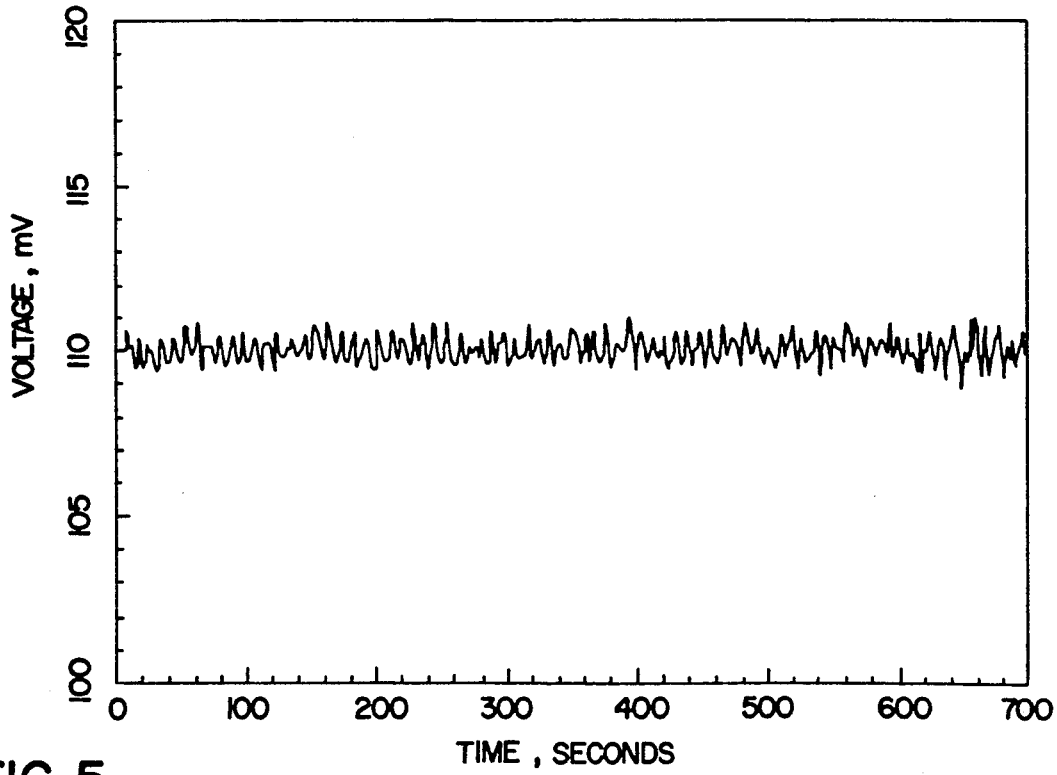

To the substrate emulsion described in Example 1 (pBr 3.29, pH 5.7 at 70° C.) were added with vigorous stirring 1.5M silver nitrate and 1.5M sodium bromide by double-jet precipitation using linearly accelerated flow (0.67 ml/min to 20 ml/min in 10 minutes). A conventional Ag/AgBr silver electrode of the second kind was used to control pBr. Approximately 0.37 mole of cubic grain AgBr emulsion was obtained which showed a double peak population of grain size distribution, indicative of the renucleation phenomenon. FIG. 4 shows the histogram of the grain volume of the substrate emulsion (E-1) and the final emulsion of this example (E-3*a* and E-3*b*). The presence of the fine grain population (E-3*b*) in the final sample yielded a smaller mean grain volume. This can be seen from the value of the mean grain volume ratio of the final sample to the substrate sample, 1.60, which was smaller than the value of 1.76 calculated under the assumption of no renucleation. FIG. 5 shows the potential of the silver electrode of the second kind as a function of time during precipitation. Note the invariance of the potential, which is indicative of the invariance of the pBr during the precipitation. By comparing FIGS. 3 and 5 it is apparent that the same potentials were recorded in each instance, which demonstrates conclusively the inability of the silver electrode of the second kind to act as an indicator of renucleation.

EXAMPLE 4

Normal Growth with Silver Electrode of the First Kind

Figure 6:
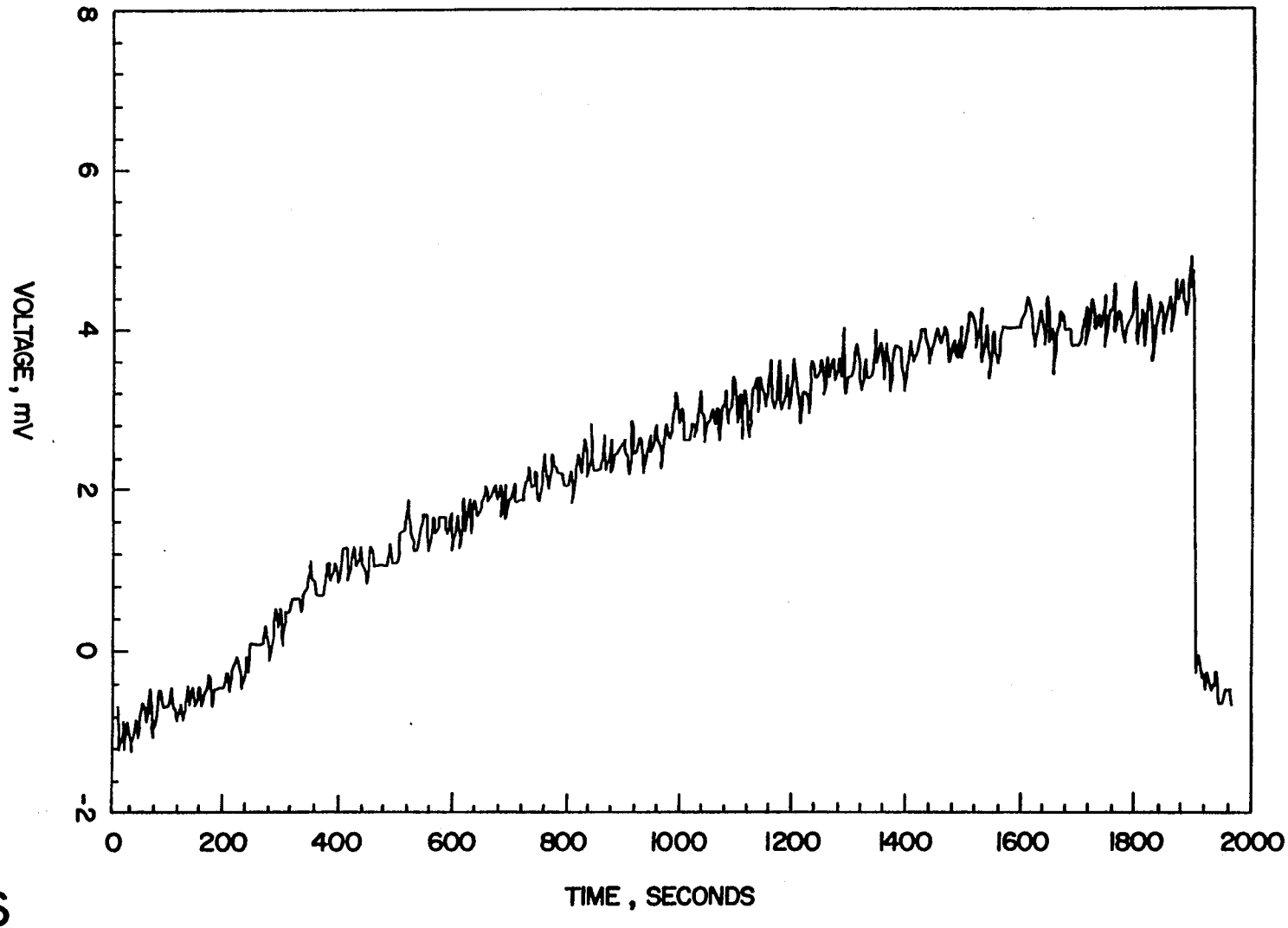
Figure 7:
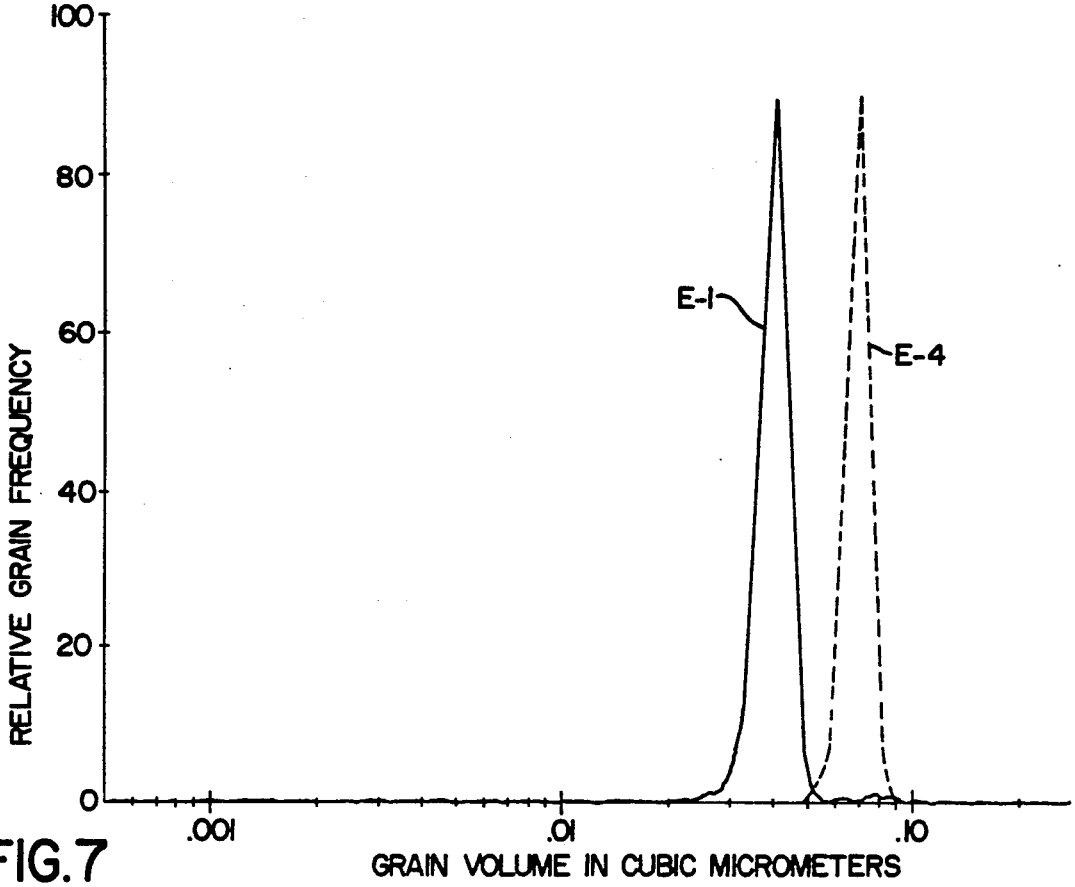

To the substrate emulsion described in Example 1 (pBr 3.29, pH 5.7 at 70° C.) were added with vigorous stirring 1.5M silver nitrate and 1.5M sodium bromide by double-jet precipitation using linearly accelerated flow (0.67 ml/min to 6.2 ml/min in 30 minutes). In addition to the conventional Ag/AgBr silver electrode of the second kind used to control pBr, a second indicator electrode, a silver electrode of the first kind (Ag/Ag+) was used to monitor the bulk silver ion activity. Approximately 0.37 mole of cubic grain AgBr emulsion with 0.41 μm mean edge length was obtained FIG. 6 shows the mV trace of the $V_S$ signal (Eq. XIII, potential difference between Ag/Ag+ and Ag/AgBr electrodes). There was a slight elevation of the $V_S$ signals in proportion to the molar silver addition rate during the precipitation, while the mV signals from the Ag/AgBr electrode was maintained at a constant value (cf. FIG. 3). The $V_S$ signals 'relaxed' back to approximately zero (i.e., equilibrium) when the addition of silver and salt stopped. FIG. 7 shows the histograms of the grain volume for the substrate emulsion (E-1) and the final emulsion (E-4) of this example, where no renucleation was observed.

EXAMPLE 5

Renucleation Growth with Silver Electrode of the First Kind

Figure 8:
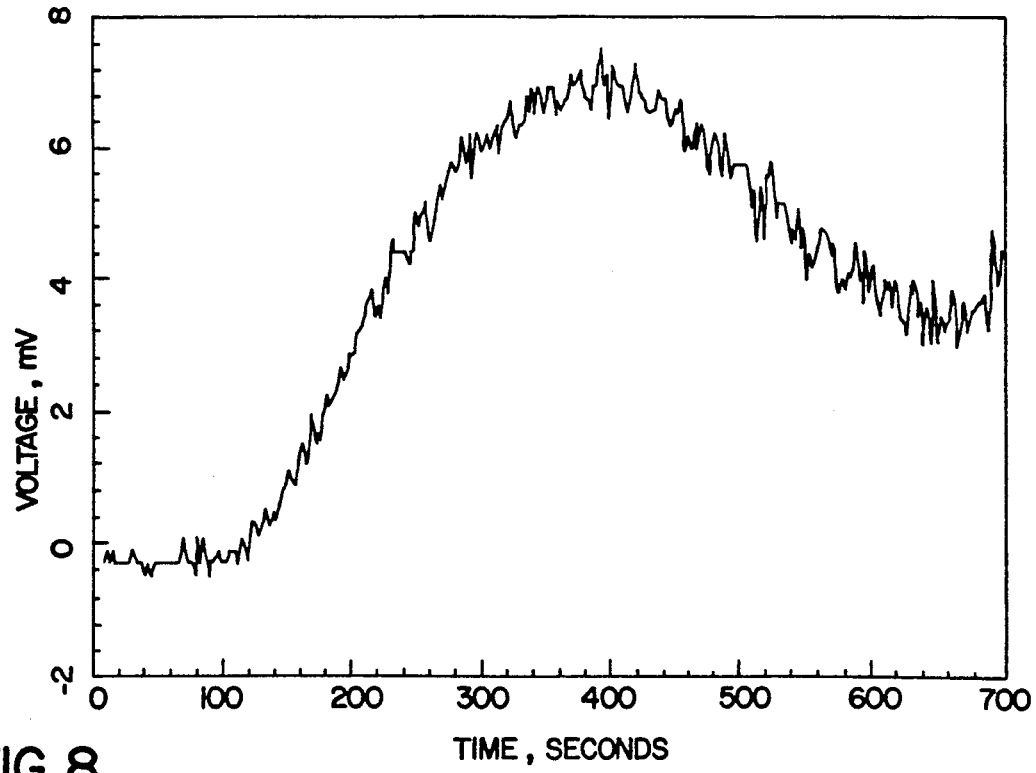
Figure 9:
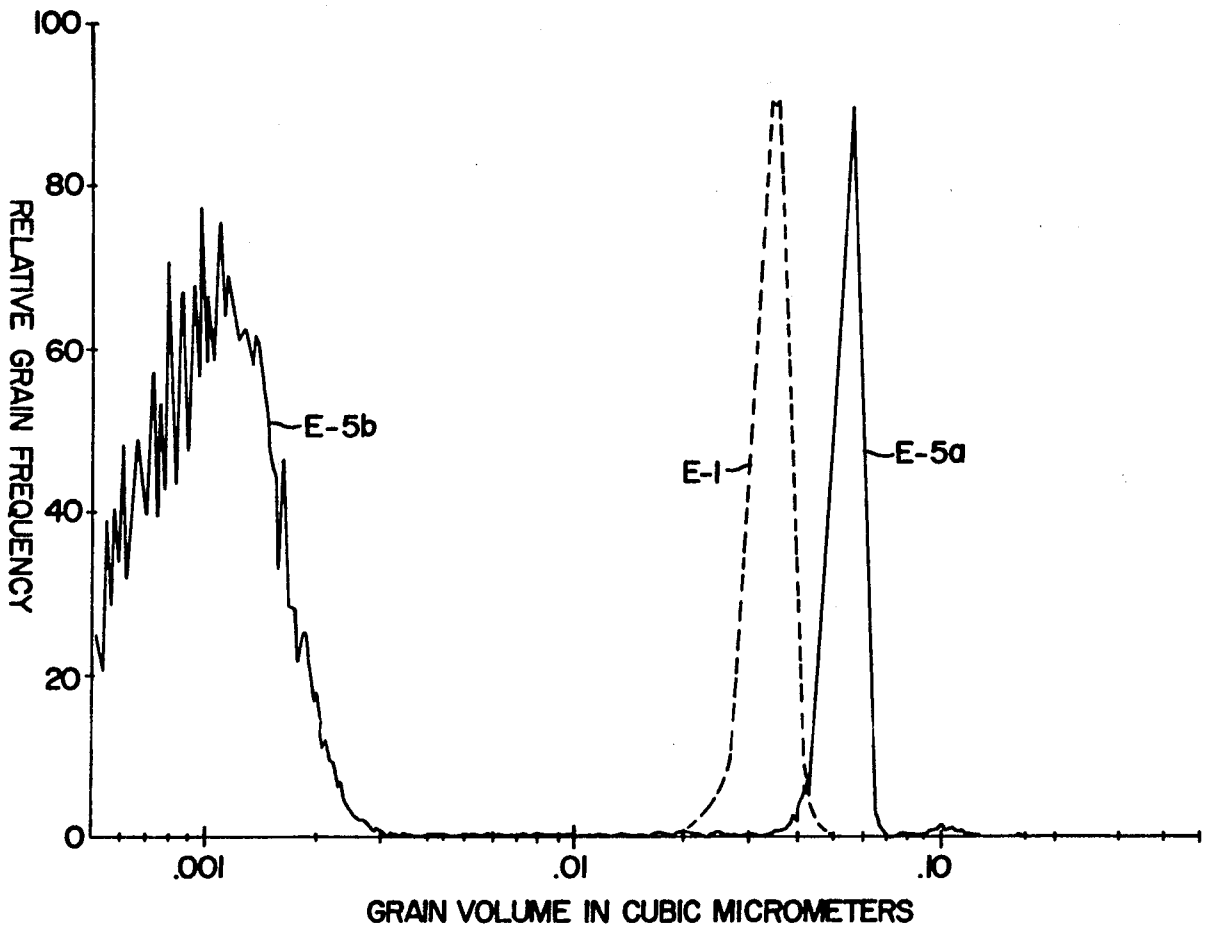

To the substrate emulsion described in Example 1 (pBr 3.29, pH 5.7 at 70° C.) were added with vigorous stirring 1.5M silver nitrate and 1.5M sodium bromide by double-jet precipitation using linearly accelerated flow (0.67 ml/min to 20 ml/min in 10 minutes). In addition to the conventional Ag/AgBr silver electrode of the second kind used for pBr control, a second indicator electrode, a silver electrode of the first kind (Ag/Ag+), was used to monitor the bulk silver ion activity. Approximately 0.37 mole of cubic grain AgBr emulsion was obtained which showed a double peak population of grain size distribution, indicative of the renucleation phenomenon. FIG. 8 shows the $V_S$ (potential difference between Ag/Ag+ and Ag/AgBr) traces of this example. Although the mV trace from the conventional silver electrode of the second kind showed no difference (cf. FIG. 3 and 5), the $V_S$ peaked at approximately 5 minutes from the start of silver addition, followed by a gradual decrease. The observed peak $V_S$ value ($\approx$7.5 mV) was higher than and differed in profile from that observed under the normal growth condition of Example 4. The initial rise of the $V_S$ signal corresponded to an increase of supersaturation level caused by the accelerated flow double-jet precipitation. Renucleation occurred when the maximal growth rate of the crystals was exceeded (approximately where $V_S$ peaked). The subsequent decrease of the $V_S$ signal corresponded to the relaxation of the supersaturation level after the renucleation. The histograms of the grain volume of the substrate emulsion (E-1) and the final emulsion (E-5*a* and E-5*b*) of this example are given in FIG. 9.

The invention has been described in detail with particular reference to preferred embodiments thereof, but it will be understood that variations and modifications can be effected within the spirit and scope of the invention. For example, in addition to silver halides, the invention is applicable to other sparingly soluble silver salts, such as silver behenate, silver thiocyanate, etc.

What is claimed is:

1. A process of precipitating a silver halide emulsion comprised of
   (a) introducing a dispersing medium and dissolved halide ions into a reaction vessel,
   (b) thereafter concurrently adding silver ions and halide ions to the dispersing medium to initiate growth of silver halide grains within the dispersing medium,
   (c) during step (b), monitoring the temperature of the dispersing medium to establish the equilibrium solubility product constant of silver an halide ions within the dispersing medium,
   (d) during step (b), using a reference electrode and a first indicator electrode each in contact with the dispersing medium within the reaction vessel, monitoring the halide ion activity within the dispersing medium and adjusting the level of dissolved halide ion in the reaction vessel by regulating the rate of addition to the reaction vessel of the halide ion to maintain a stoichiometric excess of halide ion, based on the equilibrium solubility product constant, and
   (e) during step (b), using a silver ion specific second indicator electrode in contact with the dispersing medium within the reaction vessel, monitoring the potential difference between the silver ion specific second indicator electrode and at least one of the first indicator electrode and the reference electrode to allow the level of dissolved silver ion in the dispersing medium to be determined independently of the equilibrium solubility product constant and adjusting the level of dissolved silver ion in the dispersing medium by regulating the rate of addition to the reaction vessel of the silver ion based on the potential difference thereby to maintain a selected activity profile of dissolved silver ion during silver halide grain growth.

2. A process according to claim 1 wherein the silver ion specific electrode is a silver electrode of the first kind.

3. A process according to claim 2 wherein the following relationship is employed to obtain the activity of the silver ion within the dispersing medium from the observed potential difference between the silver electrode of the first kind and the reference electrode:

$$E_{Ag(1)} = E_{Ag^+} + (RT \div F) \ln [Ag^+]_{bi}$$

where $E_{Ag(1)}$ is the potential in millivolts of the silver electrode of the first kind as compared to the potential of the reference electrode, $E_{AG^{\circ}}$ is a standard reduction potential in millivolts of a silver electrode at unity silver ion activity at the temperature of the dispersing medium, R is the gas constant (8.3145 J/mol/°K.), T is temperature (°K.), F is the Faraday constant (96,485 C/mol), and $[Ag^+]_{bi}$ is the activity of the silver ion in the dispersing medium.

4. A process according to claim 2 wherein the silver electrode of the first kind places a metallic silver containing surface in contact with the dispersing medium.

5. A process according to claim 1 wherein an electrode comprised of a silver ion permeable membrane is employed as the silver ion specific second indicator electrode.

6. A process according to claim 1 wherein a halide ion specific electrode is employed as the first indicator electrode.

7. A process according to claim 6 wherein and electrode comprised of a halide ion permeable membrane is employed as the halide ion specific electrode.

8. A process according to claim 6 wherein a silver electrode of the second kin is employed as the halide ion specific electrode.

9. A process according to claim 8 wherein an electrode comprised of a silver element coated with silver halide is employed as the silver electrode of the second kind.

10. A process according to claim 8 wherein the following relationship is employed to obtain the activity of the halide ion within the dispersing medium from the observed potential difference between the silver electrode of the second kind and the reference electrode:

$$E_{Ag(2)}=E_{Ag^{\circ}}+(RT\div F)1n(K_{SP}\div[X^-]_{bi})$$

where $E_{Ag(2)}$ is the potential in millivolts of the silver electrode of the second kind as compared to the potential of the reference electrode, $E_{AG^{\circ}}$ is a standard reduction potential in millivolts of a silver electrode at unity silver ion activity at the temperature of the dispersing medium, R is the gas constant (8.3145 J/mol/°K.), T is temperature (°K.), F is the Faraday constant (96,485 C/mol), $K_{SP}$ is the solubility product constant at the temperature of the dispersing medium, and $[X^-]_{bi}$ is the activity of the halide ion in the dispersing medium.

11. A process according to claim 1 wherein the first indicator electrode is a silver electrode of the second kind and the second indicator electrode is a silver electrode of the first kind.

12. A process according to claim 11 wherein supersaturation of the dispersing medium with silver ion is determined from the potential difference between the silver electrode of the first kind and the silver electrode of the second kind.

13. A process according to claim 1 wherein silver ion supersaturation of the dispersing medium is determined from the relationship:

$$S_{Ag}=[Ag^+]_{bi}-(K_{SP}\div[X^-]_{bi})$$

where $S_{Ag}$ is silver ion supersaturation, $[X^-]_{bi}$ is the halide ion activity of the dispersing medium determined from measurement of the potential difference between the first indicator electrode and the reference electrode, $[Ag^+]_{bi}$ is the silver ion activity of the dispersing medium determined from measurement of the potential difference between the second indicator electrode and the reference electrode, and $K_{SP}$ is the solubility product constant of the silver halide at the temperature of the dispersing medium.

14. A process according to claim 1 wherein the supersaturation ratio of the dispersing medium is determined from the relationship:

$$S=[Ag^+]_{bi}[X^-]_{bi}\div K_{SP}$$

where

S is the supersaturation ratio, $[Ag+]_{bi}$ is the silver ion activity of the dispersing medium determined from the potential difference between the second indicator electrode and the reference electrode, $[X+]_{bi}$ is the halide ion activity of the dispersing medium determined from the potential difference between the first indicator electrode and the reference electrode, and $K_{SP}$ is the solubility product constant of the silver halide at the temperature of the dispersing medium.

* * * * *